US007804975B2

(12) United States Patent
Meier et al.

(10) Patent No.: US 7,804,975 B2
(45) Date of Patent: Sep. 28, 2010

(54) IN-EAR DEVICE

(75) Inventors: Hilmar Meier, Zurich (CH); Christoph Schwob, Muttenz (CH)

(73) Assignee: Phonak AG, Stafa (CH)

( * ) Notice: Subject to any disclaimer, the term of this patent is extended or adjusted under 35 U.S.C. 154(b) by 1063 days.

(21) Appl. No.: 11/173,356

(22) Filed: Jul. 1, 2005

(65) Prior Publication Data

US 2007/0003085 A1 Jan. 4, 2007

(51) Int. Cl.
*H04R 25/00* (2006.01)

(52) U.S. Cl. ..... 381/322; 381/324; 381/328; 381/359

(58) Field of Classification Search ..... 381/312–331, 381/359, 375, 380; 181/210, 242, 135; 455/575.8
See application file for complete search history.

(56) References Cited

U.S. PATENT DOCUMENTS

| | | | | |
|---|---|---|---|---|
| 3,586,794 | A | 6/1971 | Michaelis | |
| 4,349,081 | A | 9/1982 | Pepple et al. | |
| 5,365,593 | A * | 11/1994 | Greenwood et al. | 381/322 |
| 5,524,056 | A * | 6/1996 | Killion et al. | 381/314 |
| 6,144,750 | A * | 11/2000 | Levin | 381/328 |
| 6,510,230 | B2 * | 1/2003 | Marx | 381/189 |
| 6,574,343 | B1 | 6/2003 | Meier | |
| 6,617,014 | B1 * | 9/2003 | Thomson | 428/304.4 |
| 6,661,901 | B1 * | 12/2003 | Svean et al. | 381/328 |
| 6,831,987 | B2 * | 12/2004 | Killion et al. | 381/313 |
| 7,106,876 | B2 * | 9/2006 | Santiago | 381/369 |
| 7,298,857 | B2 * | 11/2007 | Shennib et al. | 381/324 |
| 7,313,245 | B1 * | 12/2007 | Shennib | 381/325 |
| 7,551,747 | B2 * | 6/2009 | Huynh et al. | 381/325 |
| 2006/0098833 | A1 * | 5/2006 | Juneau et al. | 381/328 |
| 2008/0292124 | A1 * | 11/2008 | Rosenow et al. | 381/322 |

FOREIGN PATENT DOCUMENTS

| | | |
|---|---|---|
| DE | 200 18 829 | 2/2002 |
| WO | 99/55259 A | 11/1999 |

* cited by examiner

*Primary Examiner*—Curtis Kuntz
*Assistant Examiner*—Ryan Robinson
(74) *Attorney, Agent, or Firm*—Pearne & Gordon LLP

(57) ABSTRACT

A housing inserted in to the ear of a user is disclosed, said housing comprising a lateral end defined by being a part of the housing which is directed towards surroundings if the housing is inserted into the ear, a medial end defined by being a part of the housing which is directed towards the inner ear of the user if the housing is inserted into the ear, said medial end comprising at least a medial opening, wherein at least the lateral end of the housing is covered by a cover element. The cover element is acoustically transparent and made of open porous foam. The inventive in-ear device can be used as hearing device to improve the hearing of a hearing impaired person or as a communication device for natural as well as for remote communication.

13 Claims, 3 Drawing Sheets

IN-EAR DEVICE

TECHNICAL FIELD OF THE INVENTION

The present invention is related to an in-ear device, and more particular to hearing devices to improve the hearing of a hearing impaired person as well as to communication device to improve communication in various situations, including in sports.

BACKGROUND OF THE INVENTION

Hearing devices as well as communication devices that are inserted into a user's ear often pick up wind noise, in particular due to objects in close proximity and/or in the ear of the user. The natural shape of the pinna though prevents a human being from being exposed to too much wind noise if the maximum wind velocity is below approximately 25 m/s. For higher wind velocities, wind noise can even result from the pinna itself. It must be noted however that already wind velocities below the given value can result in wind noise from the pinna because a strong dependency is given on the angle of wind incidence. If artificial objects—as for example an earphone, a hearing device or a communication device—is placed in the pinna, i.e. in the cavum-concha, or even in the ear canal, wind noise resulting from turbulences due to such an object occur and degrade the quality of hearing or communication because of a lowering of signal-to-noise ratio (SNR).

For even higher wind velocities than the one mentioned above, signal-to-noise ratio is further reduced by wind noise resulting from the pinna itself.

For communication devices, such as cellular phones, headsets are used which are connected via a cable to the communication device. A microphone is attached to this cable in between the headset and the cellular phone in order to provide bidirectional transmission. Having said this it becomes apparent that strong winds lead to strong turbulences which in turn lead to disturbing noise and reduced signal-to-noise ratio. The so-called "walkman" headsets with or without incorporated microphones—the latter being used in connection with MP3 players, for example—are not suitable for the intended use.

Standard "walkman" headphones also used for MP3 players like iPod or other portable communication devices like radio sets employ miniature dynamic receivers (also called earphones) and usually come with an acoustically transparent foam cover to protect the receiver from ear wax or other dirt. The disadvantages of existing solutions are the wearing comfort (loose fit in the ear and cable) and the communication quality.

Similar headsets claimed to be for sports and/or outdoors are designed to be water resistant but are not suitable for using in conditions with high velocity wind streams. All presently known solutions comprise a screen on the microphone in order to prevent the intrusion of dirt and ear wax into the ear.

In U.S. Pat. No. 6,574,343B1, a hearing aid is disclosed having an acoustic input aperture and a cover element covering the acoustic input aperture. The cover element is received in the hearing aid housing and its surface is flush with that of said housing. The cover element is made of a porous material. It has been found that wind noise due to turbulences particularly caused by strong winds has a major impact on the performance of such a known hearing aid in that the signal-to-noise ratio is rather low.

Therefore, one object of the present invention is to improve signal-to-noise ratio and to further reduce wind noise influence on the performance of in-ear devices, i.e. of hearing devices or communication devices.

SUMMARY OF THE INVENTION

The present invention is directed to a device comprising a housing to be inserted into an ear of a user, said housing comprising a lateral end defined by being a part of the housing which is directed towards surroundings if the housing is inserted into the ear, a medial end defined by being a part of the housing which is directed towards the inner ear of the user if the housing is inserted into the ear, said medial end comprising at least a medial opening, wherein at least the lateral end of the housing is covered by a cover element.

The term "in-ear device" as it is used throughout this specification must be understood as any device which is fully or partly inserted into the ear; in particular such a device might be one of the following:

- Behind-the-ear (BTE) hearing device: The microphone, electronics, and speaker are mounted in the characteristic banana-shaped housing, and the sound is conveyed acoustically via a tube to a custom earmold.
- In-the-ear (ITE) hearing device, which vary in size from full concha styles that fill the entire concha as well as about half the length of the ear canal. Smaller sizes do exist which do not extend outwards from the ear canal sufficiently to fill the concha.
- In-the-canal (ITC) hearing device.
- Completely-in-the-canal (CIC) hearing device fit entirely within the ear canal.

Although the above-mentioned examples have been cited in connection with hearing devices, they can similarly be used for communication devices as it will become apparent in connection with the detailed description of embodiments of the present invention.

It is one aspect of the present invention that the acoustically transparent cover element made of open porous foam covers at least the lateral end. Furthermore, the characteristics of the material for the cover element can best be described by one or several of the following properties:

- thickness from 1 to 4 mm, particular from 1.5 mm to 2.5 mm, more particular approximately 2.2 mm;
- pore size from 0.1 to 0.5 mm, particular from 0.1 to 0.3 mm, more particular of approximately 0.2 mm;
- pore density from 50 to 120 pores per inch (ppi), particular from 60 to 100 ppi, more particular approximately 80 ppi;
- tensile strength from 10 to 50 psi, particular form 20 to 40 psi, more particular approximately 30 psi;
- elongation above 200%, particular above 300%, more particular approximately 350%;
- compression load deflection at 25% from 0.2 to 0.5 psi, particular from 0.3 to 0.4 psi;
- compression load deflection at 65% from 0.35 to 0.75 psi, particular from 0.45 to 0.65 psi;
- water-repellant (hydro phobic);
- olio phobic.

In a specific embodiment of the present invention, the material for the cover element is reticulated foam which is a flexible polyurethane foam characterized by a three-dimensional skeletal structure with few or no membranes between strands.

The product is thermally reticulated, a process which removes the cell walls, leaving a material of skeletal structure having a void area of some 97%. In addition the thermal reaction considerably increases the physical strength of the material. This is achieved by the material removed in the process unblocking the cells being wrapped around the cell struts. This increases the strut thickness and results in an increased tensile strength and greater resistance to heat, abrasion and chemical attack.

Thermal reticulation is a post-manufacturing process that completely removes the membrane between foam cell strands, maximizing uniformity of the cell structure.

The flexibility and extendibility of the material for the cover element still allows operating a push bottom or a switch positioned at the lateral end of the housing.

In a further specific embodiment of the present invention, the visible part of the cover element is either adapted to the skin color of the in-ear device user or has a fashion color in order to serve to catch the eye of other people.

A specific embodiment of the present invention in which at least one lateral opening is operatively connected to a corresponding medial opening via a canal or tube allows natural communication without being influenced by the in-ear device. Furthermore, if the in-ear device is equipped with a transmission unit, e.g. a FM-transmitter, communication via the transmission unit as well as natural communication with surroundings of the in-ear device user is possible at the same time.

The present invention is particularly suitable for using in sports, for example by cycling teams guided by a team leader sitting, for example, in a service car, the team leader being able to communicate with all the team members. At the same time, natural communication between the team members is guaranteed. The communication with the team leader can be unidirectional or bidirectional, wherein at least in the latter case a microphone must be provided in close proximity to a corresponding rider.

The present invention thus comprises a communication headset system being suitable to provide communication in a unidirectional or in a bidirectional way via a team radio while at the same time a direct, i.e. natural and unprocessed, communication between the team members is possible.

In a further embodiment of an application in sports, as for example the cycling team communication system mentioned above, it is feasible to support the direct communication in that also the direct communication is processed in the in-ear device in order to improve intelligibility.

In addition, the in-ear devices according to the present invention may be individualized in that the shape of the housing is fitted to the topology of the user's ear. Thereby, the wearing comfort is maximized while the holding of the device in the ear is optimized at the same time.

DETAILED DESCRIPTION OF THE INVENTION

Figure 1:
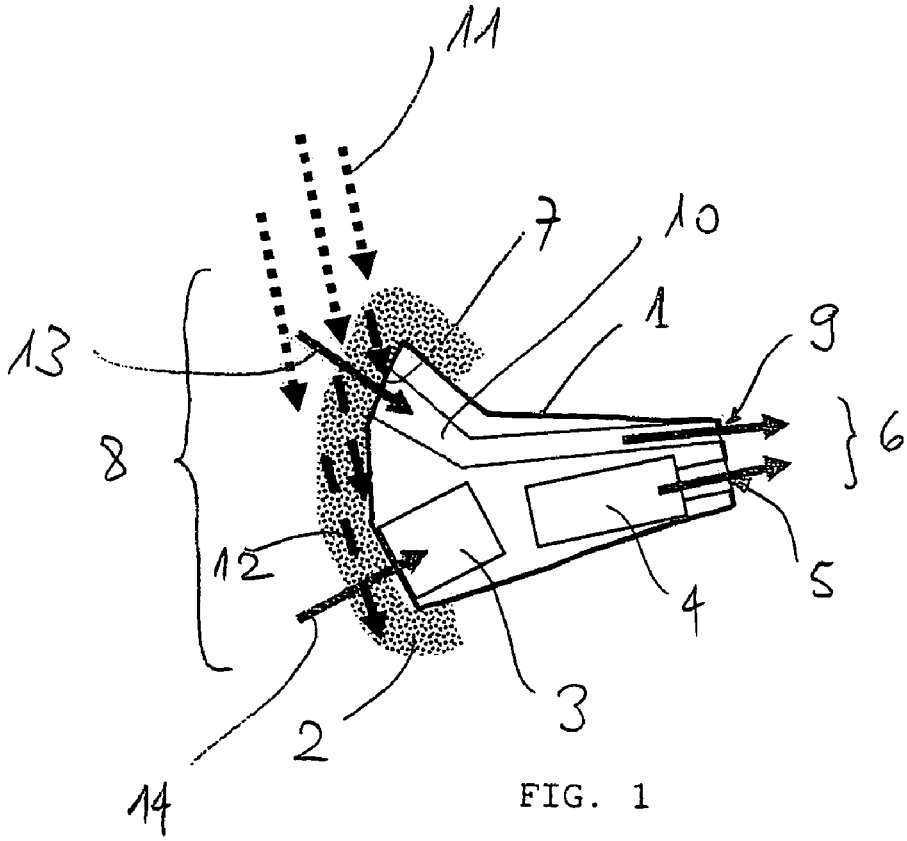
FIG. 1 schematically shows a first embodiment of an in-ear device with a cover element according to the present invention.

In FIG. 1 an in-ear device is depicted comprising a housing 1 and a cover element 2 according to the present invention. The housing 1 has a lateral end 8 which is defined by being a part of the housing 1 which is directed towards surroundings if the housing 1 is inserted into the ear of a user. Furthermore, the housing 1 has a medial end 6 which is defined by being a part of the housing 1 which is directed towards the inner ear of the user if the housing 1 is inserted into the ear of the user. In between the lateral end 8 and the medial end 6, a housing section 16 is provided to complete the housing 1, the housing section 16 being individualized in that its shape is adapted to the topology of the user's ear in order to obtain an optimized user comfort and a maximized holding.

The housing 1 comprises components or elements which are schematically depicted in FIG. 1. First, a converter 4 is provided in close proximity of the medial end 6, an output port of the converter 4 being connected via a tube to the medial opening 5. The converter 4 is, for example, an electro-acoustical converter, such as a speaker, that converts an electrical signal into an acoustical signal.

In a further embodiment of the present invention, the converter is realized in such a way that a direct stimulation of the auditory nerve is possible. Such a realization uses the technology of implantable devices.

The housing 1 further comprises a transmission unit 3 that can be implemented using different technology as it becomes apparent by the embodiment described further on. In FIG. 1, the transmission unit 3 is a receiver unit for receiving radio signals coming from a walky-talky, for example. The radio signal is schematically represented by an arrow 14 which points into the transmission unit 3.

FIG. 1 does not show a connection between the transmission unit 3 and the converter 4. In fact, these components are operatively connected either directly or via a signal processing unit (not shown in FIG. 1) in order to be able to transmit or exchange information which has been received by the transmission unit 3.

The housing 1 further comprises a canal 10 or tube-like connection between the medial opening 9 in the medial end 6 and a lateral opening 7 in the lateral end 8. The cross-section of the canal 10 is adapted to fulfill requirements of acoustical transmission of sound from surroundings to the inner ear in order to enable natural communication as defined above. Therewith, it is possible for the user of the in-ear device to communicate directly with a person in the vicinity while at the same time information via the transmission unit 3 and the converter 4 can be heard by the user. It has been shown that—in order to obtain a sufficient cross-sectional area of the canal 10—more than one canal 10 leads to a better transmission characteristic for sound to receive the inner ear of the user of the in-ear device. In a specific embodiment of the present invention, two canals 10 are provided each of which connects a lateral opening 7 to a medial opening 9. Accordingly, the number of openings in the lateral end 8 and the medial end 6, respectively, is increased accordingly.

According to the present invention, at least the lateral end 8 of the housing 1 is covered by a cover element 2 acting as a wind screen which suppresses the wind noise that degrades the communication quality. Therewith, the quality of communication is improved for natural communication with co-riders (in this case for cyclists in sports application) and the communication via the team radio.

The cover element 2 can be described as an open porous and mechanically soft material with a certain average pore size and a certain thickness which depends on the required degree of wind noise suppression. The cover element 2 is spanned over the entire lateral end 8 of the housing 1 that is visible from the outside.

The cover element 2 according to the present invention in particular prevents wind noise in two different ways. Due to the soft and open porous structure of the cover element 2 and the fact that the cover element 2 is covering the entire housing surface exposed to potential wind streams, it prevents the generation of additional wind noise caused by turbulent streams at the housing 1 in two ways:

Strong wind streams are diffracted on the mechanically soft and light weight fine structure of the cover element 2 without causing wind noise.

Wind streams are reduced in velocity by the open porosity of the cover element 2, which also leads to reduced wind noise otherwise resulting from turbulences at the outlines of the housing 1.

In particular, the generation of wind noise at the lateral openings 7 of the canal 10 required to let natural sounds pass through the housing 1 to the ear drum is reduced.

The design of the canal 10 can be in the form of a tube, or can be designed with one or more openings into a hollow housing 1 on the lateral side, i.e. in the lateral end 8 of the housing 1, and one or more openings on the medial side, i.e. in the medial end 6 of the housing 1.

The entire housing 1 comprises at least one speaker 4 (also called earphone) and at least one transmission unit 3 as signal input device which can be an FM-(Frequency Modulated) radio receiver, a simple audio signal wire or one or more microphones. The latter two embodiments will be further described in connection with FIG. 2 to 6.

To be able to concurrently communicate acoustically in the "natural" way at least a canal 10 is required to allow acoustic signals—except for wind noise—to pass through the housing 1.

It has been shown that a material for a cover element 2 as in general terms described above has one or more of the following properties:

thickness from 1 to 4 mm, particular from 1.5 mm to 2.5 mm, more particular approximately 2.2 mm;

pore size from 0.1 to 0.5 mm, particular from 0.1 to 0.3 mm, more particular of approximately 0.2 mm;

pore density from 50 to 120 pores per inch (ppi), particular from 60 to 100 ppi, more particular approximately 80 ppi;

tensile strength from 10 to 50 psi, particular form 20 to 40 psi, more particular approximately 30 psi;

elongation above 200%, particular above 300%, more particular approximately 350%;

compression load deflection at 25% from 0.2 to 0.5 psi, particular from 0.3 to 0.4 psi;

compression load deflection at 65% from 0.35 to 0.75 psi, particular from 0.45 to 0.65 psi;

water-repellant (hydro phobic);

olio phobic.

In a specific embodiment of the present invention, the material for the cover element 2 is reticulated foam which is a flexible polyurethane foam characterized by a three-dimensional skeletal structure with few or no membranes between strands.

The product is thermally reticulated, a process which removes the cell walls, leaving a material of skeletal structure having a void area of some 97%. In addition the thermal reaction considerably increases the physical strength of the material. This is achieved by the material removed in the process unblocking the cells being wrapped around the cell struts. This increases the strut thickness and results in an increased tensile strength and greater resistance to heat, abrasion and chemical attack.

Thermal reticulation is a post-manufacturing process that completely removes the membrane between foam cell strands, maximizing uniformity of the cell structure.

Figure 2:
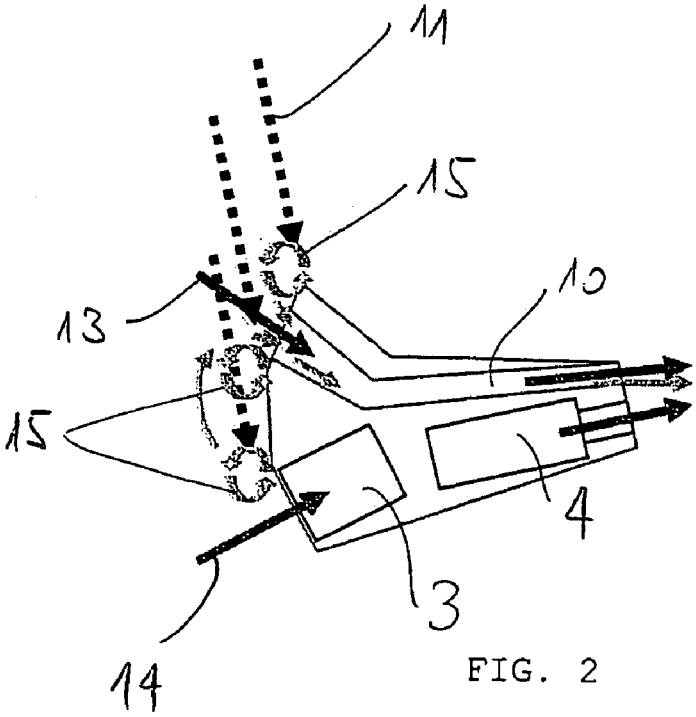
FIG. 2 shows the in-ear device of FIG. 1 without cover element for demonstration of turbulences.

The effect of a cover element 2 made of a material having at least one of the above-mentioned properties will be explained by referring to FIGS. 1 and 2, in which strong wind streams are indicated by the arrow 11. While the housing 1 of FIG. 1 is covered by a cover element 2 on the lateral end 8, the housing 1 of FIG. 2 is not covered at all. In the absence of a cover element 2, wind turbulences develop not only at edges, as for example at the lateral opening 7, but also at the housing 1 itself. These turbulences lead to wind noise propagating through the canal 10 into the ear of the user of the in-ear device.

The cover element 2 reduces the strong wind streams in that deformation of the cover element 2 occurs having the effect of diffracting the wind stream, and, for the wind stream entering the cover element 2, canalizing the wind stream therein. As a result, no or less wind turbulences develop and the signal-to-noise ratio is increase compared to a housing 1 having no cover element 2.

Figure 3:
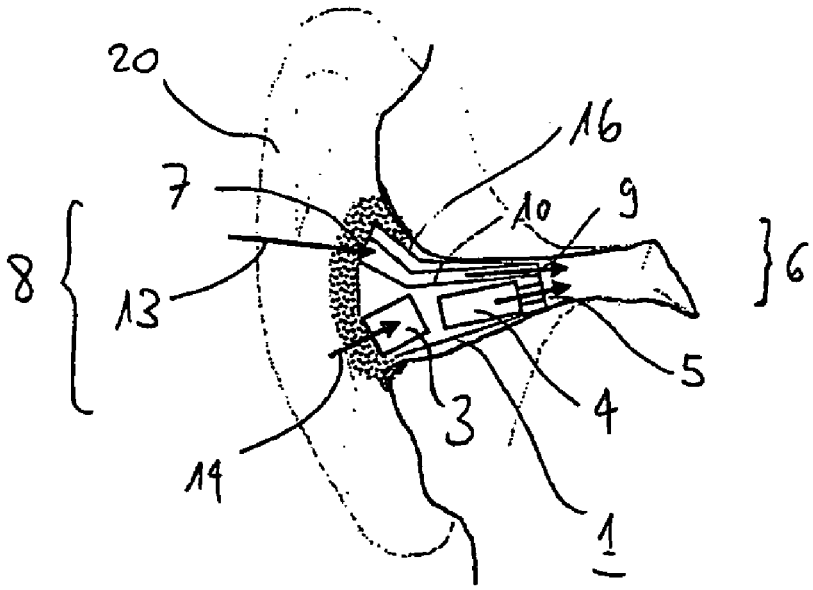
FIG. 3 shows the in-ear device of FIG. 1 inserted in an ear of a user.

In FIG. 3, the in-ear device of FIG. 1 is inserted into an ear of the user. The cover element 2 not only covers the part of the housing 1 facing the outside but also a part of the housing section 16. This has the advantage that the in-ear device is hold by the cover element 2 because the compression load deflection of the material of the cover element 2 allows the build-up of holding forces when reacting with the concha. Furthermore, depending on the used device type (ITE, ITC, CIC, etc.), the concha or the ear canal, respectively, is completely covered by the cover element 2 in that there is no possibility that a gap is formed between the housing 1, i.e. the housing section 16, and the ear. Such a gap could otherwise again give rise to turbulences leading to wind noise entering the canal 10.

A further embodiment of the present invention having the same structure as the one shown in FIG. 3 consists in that the transmitter unit 3 does not directly communicate with the equipment (e.g. a walky-talky) of the team leader. Instead an intermediate transmission unit (not shown in FIG. 3) is provided which is in proximity to the inventive in-ear device. In such an embodiment, a low power consuming wireless link (e.g. Bluetooth or an inductive transmission link) having a rather short transmission distance is used for transmitting data from the in-ear device to the intermediate transmission unit, while a rather high power wireless link (e.g. the mentioned FM-transmission) is used to transmit data further. Therewith, the in-ear device can operate longer with the same battery.

Figure 4:
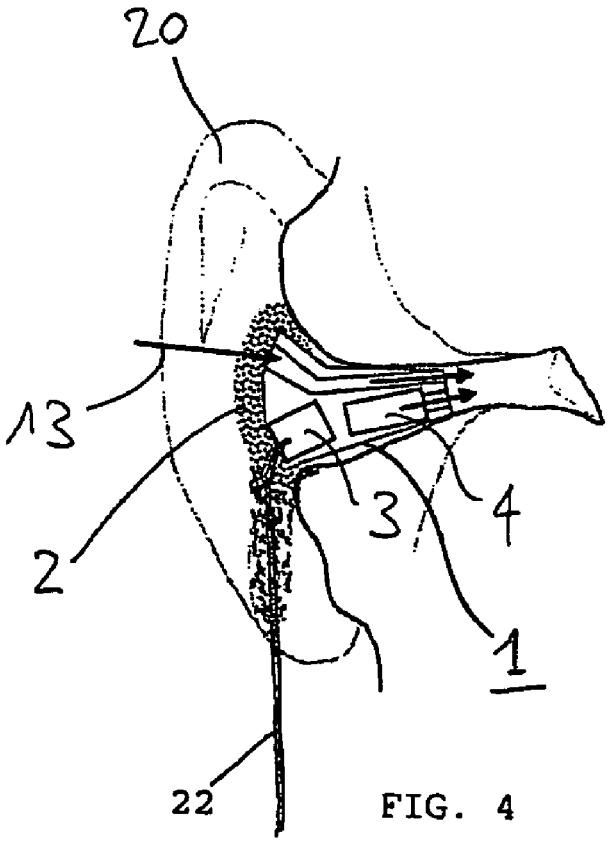
FIG. 4 shows a second embodiment of the present invention with a wired connection to an external device.

FIG. 4 shows a further embodiment of the present invention in which a cable 22 is connected to the transmission unit 3, the cable 22 being connected to an intermediate transmission unit (not shown), for example. In order to minimize turbulences due to the cable 22 itself, it is to some extend also covered by the same material as the cover element 2.

Figure 5:
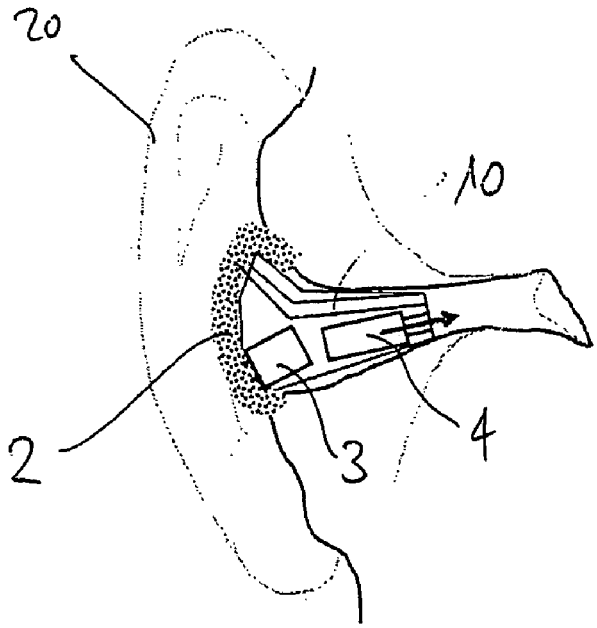
FIG. 5 shows a third embodiment of the present invention with a microphone in order to be operative as hearing device.

A yet another embodiment of the present invention is depicted in FIG. 5 showing a hearing device to improve the hearing of a hearing impaired user. While the converter 4 is in the simplest application a speaker, the transmission unit 3 (FIGS. 1 to 4) is a microphone recording sound and transmitting it to a signal processing unit (not shown in FIG. 5) in which the hearing impairment of the user is corrected as completely as possible. The signal processing unit is operatively connected to the converter 4. Again, in a specific embodiment, the converter 4 can be directly or indirectly be used to stimulate the acoustic nerve of the user by using implantable device technology.

It has to be noted for this application that the canal 10 is rather used as a so-called vent than for providing a sound inlet as it is the case for in-ear devices as described in connection with the embodiment shown in FIGS. 1 to 4. The cross-sectional area of a vent is just as large as it is necessary for pressure equalization between surroundings and the inner ear. A sound transmission through the canal 10 is prevented to a high extend since such sound transmission would generally confuse the hearing device user.

Figure 6:
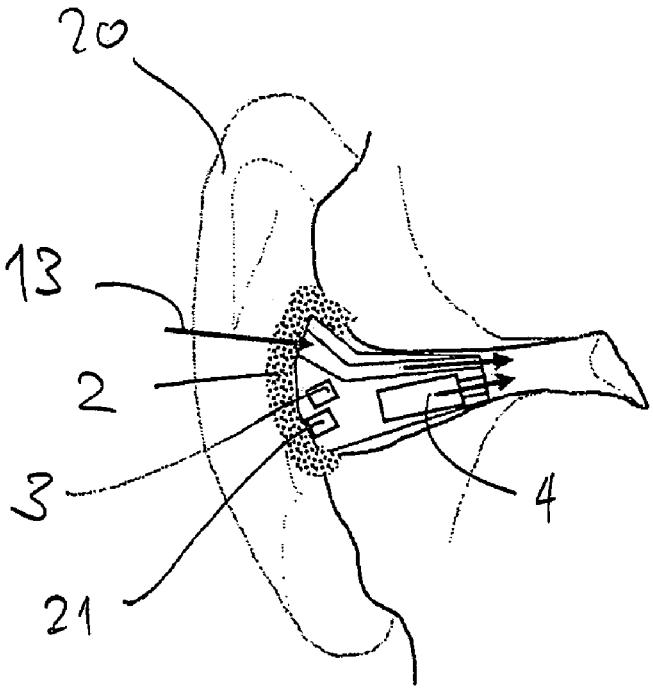
FIG. 6 shows a fourth embodiment of the present invention comprising a microphone and a transmission unit.

With reference to FIG. 6 a further embodiment of the present invention is described. As has been already stated, the inventive in-ear device can be used as a one or two way telecommunication system. A one way communication system consists of a converter 4 (e.g. a speaker) and one transmission unit 3 acting as a receiver unit. A two way "team radio" communication requires a transmission unit 3 being able to transmit data in a bidirectional manner, a converter 4 to listen to the team radio and a microphone 21 to pick up the voice of the in-ear device user. The sound picked-up by the microphone 21 can be transmitted to an external receiver unit (e.g. a walky-talky) via the bidirectional transmission unit 3. It is clear for the skilled artisan having knowledge of the present invention how to design, interconnect and operate the in-ear device in order to fulfill the required operations.

Finally it is pointed out that it is not mandatory for the cover element 2 to be positioned as close as possible over the housing 1 of the in-ear device. Therefore, a further embodiment of the present invention comprises a cover element covering the entire ear (i.e. pinna) of the user preventing therewith also any turbulences resulting from the pinna. Such an application can be used for even higher wind streams with wind velocities well above 25 m/s. An even further embodiment being exposable to similar or even higher wind velocities, the cover element is a cap made of the same material as disclosed above in connection with the cover element attached to the housing. This type of cover element is pulled over the upper part of the user's head or even over the entire head with the result that no turbulences at all must be dealt with.

Having thus shown and described embodiments of the present invention, it should be noted that the same has been made by way of illustration and not limitation. Accordingly, all modifications, alterations and changes coming within the spirit and scope of the present invention are herein meant be included.

The invention claimed is:

1. A device comprising:

a housing to be inserted into an ear of a user, said housing comprising:

a lateral end defined by being a part of the housing which is directed towards surroundings if the housing is inserted into the ear, a medial end defined by being a part of the housing which is directed towards the inner ear of the user if the housing is inserted into the ear, said medial end comprising at least a medial opening, a housing section defined by being a part of the housing which is between the lateral end and the medial end, wherein the entire lateral end of the housing and at least part of the housing section to be inserted into the ear of the user are covered by a cover element that is exposed to potential wind streams from the outside of the ear when the device is in the ear;

wherein the cover element is made of reticulated foam; and wherein the cover element has the property of compression load deflection at 25% from 0.2 to 0.5 psi, compression load deflection at 65% from 0.35 to 0.75 psi, and at least one of the following properties:

thickness from 1 to 4 mm;

pore size from 0.1 to 0.5 mm;

pore density from 50 to 120 pores per inch (ppi);

tensile strength from 10 to 50 psi;

elongation above 200%;

water-repellant (hydro phobic);

olio phobic.

2. The device of claim 1, wherein the cover element is made of polyurethane.

3. The device of claim 1, wherein at least a visible part of the cover element is adapted either to skin color of the user or has a fashion color in order to catch the eye of other people.

4. The device of claim 1, wherein said lateral end comprises at least a lateral opening which is connected to a medial opening via a canal.

5. The device of claim 1, wherein said housing further comprises a converter unit acting through the medial end.

6. The device of claim 5, wherein said converter unit is an electro-acoustical converter having an acoustic output port which is operatively connected to a further medial opening.

7. The device of claim 1, wherein said housing further comprises a converter unit acting through the medial end, at least a microphone having an acoustic input port which is operatively connected to a further lateral opening, and a signal processing unit which is operatively connected to the at least one microphone as well as to the converter unit.

8. The device of claim 5, wherein said housing further comprises a transmission unit which is operatively connected to the converter unit.

9. The device of claim 8, wherein said lateral end comprises at least a lateral opening which is operatively connected to a medial opening via a canal.

10. A use of the device of claim 1 to compensate a hearing loss of a user.

11. A use of the device of claim 1 for natural communication as well as for remote communication via a wired or a wireless transmission link.

12. The device of claim 1, wherein the cover element exerts a holding force against the ear.

13. The device of claim 1, wherein the cover element deforms in response to a wind stream to diffract the wind stream and wherein the portion of the wind stream that enters the cover element is canalized to reduce the wind stream.

* * * * *